United States Patent [19]

Stewart

[11] Patent Number: 4,468,032

[45] Date of Patent: Aug. 28, 1984

[54] CARD HOLDER

[76] Inventor: Ralph E. Stewart, Manvel, Tex. 77578

[21] Appl. No.: 497,063

[22] Filed: May 23, 1983

[51] Int. Cl.[3] ..... A63F 9/00

[52] U.S. Cl. ..... 273/148 A; 40/124.4; 211/128

[58] Field of Search ..... 40/124, 124.4; 46/12, 46/31; 211/128; 273/148 A, 150, 269, 285

[56] References Cited

U.S. PATENT DOCUMENTS

| | | | |
|---|---|---|---|
| 2,634,132 | 4/1953 | Freedman | 273/150 X |
| 2,785,901 | 3/1957 | McLemore | 273/150 |
| 3,323,801 | 6/1967 | Babcock | 273/150 |
| 4,291,882 | 9/1981 | Monte | 273/148 A |
| 4,418,913 | 12/1983 | Hamilton | 273/150 |

FOREIGN PATENT DOCUMENTS

| | | | |
|---|---|---|---|
| 163505 | 7/1949 | Austria | 273/150 |

*Primary Examiner*—Harland S. Skogquist
*Attorney, Agent, or Firm*—Ranseler O. Wyatt

[57] ABSTRACT

A card holder for holding cards, such as Bingo cards, having a projecting platform and having parallel, slotted members, positioned between two end members, and aligned to receive cards in vertical alignment, so that the playing numbers for each letter will be readily viewed.

A modified form provides means for stacking the holders.

4 Claims, 4 Drawing Figures

FIG. 3
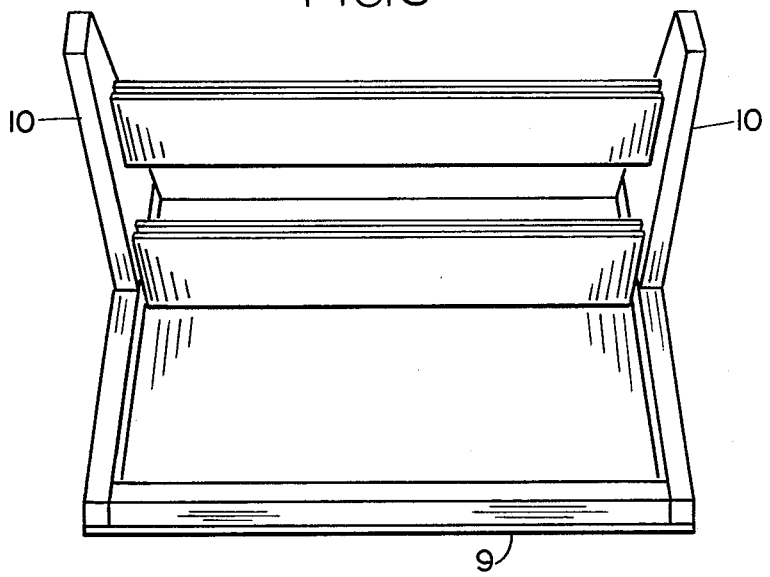
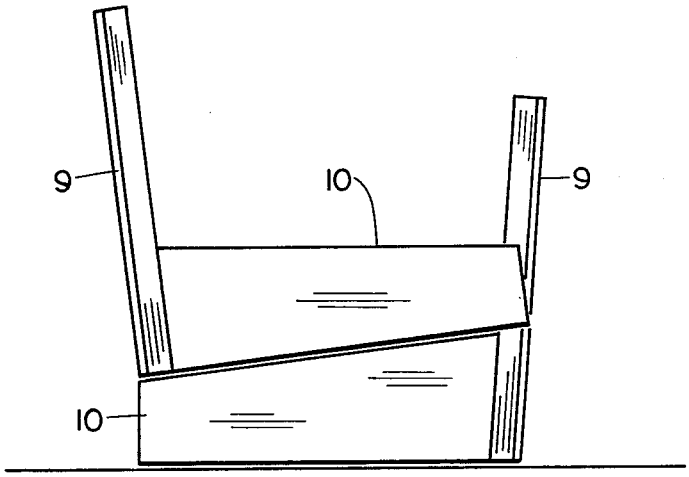
FIG. 4

CARD HOLDER

SUMMARY OF THE INVENTION

A card holder having a supporting end member and parallel cross members having a slot on the upper margins thereof, and a platform extending outwardly from said end members having an upstanding peripherial barrier. Said barrier and slotted cross members are adapted to maintain three rows of cards, such as are used in playing Bingo, in vertically aligned relation.

BACKGROUND OF THE INVENTION

The presently popular game of Bingo is played with cards having the letters B I N G O at the top and rows of numerals thereunder and in alignment with the respective letters. Players using a multiple set of cards experience difficulty in aligning same to scan the card quickly, and mark the numbers called timely. This display of cards requires space, limiting the facilities available for players, as well as making it difficult to properly check all numbers called. It is the object of this invention to provide a holder for a number of such cards, arranged to provide easy survey of numbers under each letter, as called.

BRIEF DESCRIPTION OF THE DRAWINGS

FIG. 3 is a perspective view of a modified form of the invention.

FIG. 4 is a view of two of the devices of FIG. 3 stacked in a pile.

DESCRIPTION OF THE PREFERRED EMBODIMENTS

Figure 1:
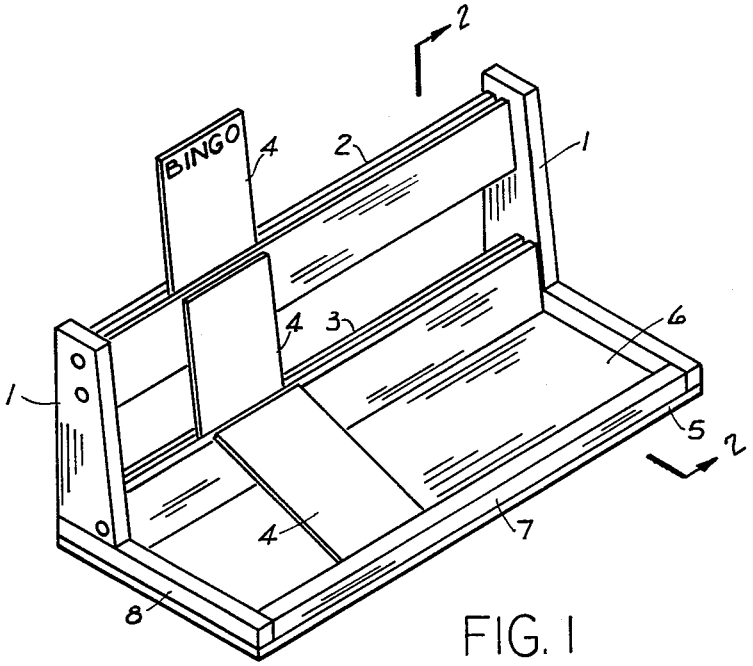
FIG. 1 is an elevated perspective view, showing cards in position on the holder
Figure 2:
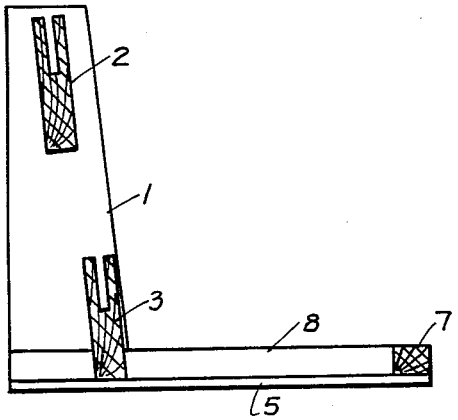
FIG. 2 is a cross sectional view, taken on the line 2—2 of FIG. 1.

In the drawings, the numerals 1, 1 designates the end members which support the cross members 2, 3, which are slotted on their upper margin to a depth sufficient to receive and maintain upright playing cards, as 4. The end members 1, 1 have a tapered forward face, the base of the end members being wider than the top, and the cross members 2, 3, are secured to the end members at the same angle as the said taper.

The entire device is mounted on a floor 5, and a platform 6 extends outwardly from the end members 1, 1 and a barrier 7,8 is mounted on the extended portion of the platform. Cards, as 4, are mounted in the groove in the cross members 2, 3, the members 2 is aligned with the member 3, so that the groove of the member 3 is forward of the groove of the member 2, so that a card in the upper grooved member, will be slightly behind the card in the other member, and a third card will rest on the platform 6, one end touching the barrier and the other end touching the member 3 immediately below the card mounted therein. All letters and numbers in each card of each vertical row will be aligned. The preferred size is sufficient for five rows.

In the modified form, shown in FIG. 3, the base member 9 is reduced longitudinaly so the end members 10, 10, slant inwardly, from top to bottom, providing ability to nest the structures in easily stored piles.

What I claim is:

1. In a card holder, end members having upwardly tapered forward faces, cross members mounted on said end members, grooves in the upper margin of said cross members and a platform extending outwardly from said cross members; said end members slanting inwardly from top to bottom, providing means for stacking.

2. The device defined in claim 1 wherein said cross members are mounted at an angle in alignment with said tapered faces of said end members.

3. The device defined in claim 1 wherein an upstanding barrier is formed on said platform.

4. The device defined in claim 1 wherein said end members project outwardly from bottom to top, to permit stacking.

* * * * *